US005408800A

United States Patent [19]

Hsu

[11] Patent Number: 5,408,800

[45] Date of Patent: Apr. 25, 1995

[54] PACKING MACHINE FOR SPHERICAL VEGETABLES

[76] Inventor: Margaret Hsu, 3F, No. 6, Alley 8, Lane 19, Rong-Hwa Second Rd., Peitu Taipei, Taiwan, Prov. of China

[21] Appl. No.: 108,300

[22] Filed: Aug. 19, 1993

[51] Int. Cl.[6] ..... B65G 11/10; B65G 49/00; B65B 11/06

[52] U.S. Cl. ..... 53/221; 53/228

[58] Field of Search ..... 53/219, 221, 222, 226, 53/370.7, 464, 556, 228, 370.4

[56] References Cited

U.S. PATENT DOCUMENTS

| | | | |
|---|---|---|---|
| 3,967,433 | 7/1976 | Bonfiglioli | 53/228 |
| 3,991,542 | 11/1976 | White et al. | 53/586 |
| 4,078,363 | 3/1978 | Ranzi | 53/228 |
| 4,513,558 | 4/1985 | Treiber | 53/556 |
| 4,548,024 | 10/1985 | Fine | 53/556 |

*Primary Examiner*—Linda B. Johnson
*Assistant Examiner*—Rodney A. Butler
*Attorney, Agent, or Firm*—Bacon & Thomas

[57] ABSTRACT

A packing machine for spherical vegetables includes a machine body, a film-cutting part, a film-gripping part, a clamp device and a heat sealing mechanism. The film-cutting part is installed on the rear part of the machine body and can be moved upwardly and downwardly. The clamp device is situated behind the film-cutting part for clamping the packing film. Furthermore, the film-gripping part is installed opposite to the clamping device and can slide forwardly and backwardly upon two guide rails by means of a motor driven transmission chain. When starting the packing machine, the film-gripping part moves forwardly to the clamping device to grip the packing film and then returns to its original position. Meanwhile, the film-cutting part is lowered to cut off the packing film. Then a spherical vegetable is placed on the packing film from a loading holder which is automatically lowered to an appropriate position while the heat sealing mechanism clamps and seals an upper part of the packing film.

1 Claim, 7 Drawing Sheets

PACKING MACHINE FOR SPHERICAL VEGETABLES

BACKGROUND OF THE INVENTION

This invention relates to a packing machine for spherical vegetables, especially a packing machine which is composed of a machine body, a film-gripping part, a film-cutting part, a loading holder with lifting mechanism, a clamping device and a heat sealing mechanism and can wrap spherical vegetables automatically.

For purpose of retaining the fresh of vegetables, we always use plastic bag or packing film to wrap vegetables, but such kind of packing methods being operated by manual labor. In packing process, the plastic bag or operator's hands damage the surface of vegetable and cause a rot. It spends too much time and labor for wrapping vegetables by manual operation, therefore the packing machines are developed under this condition so as to solve the above question, but vegetable must be placed on a polystyrene tray to wrap, such kind of packing method doesn't match the reguest of environmental protection and spend more time and cost.

SUMMARY OF THE INVENTION

It is therefore the main object of this invention to provide a packing machine which can grip and cut packing film, also can seal the packed vegetable automatically, the surface of spherical vegetable wouldn't be damaged in packing and sealing procedure.

It is another object of this invention to provide a packing machine which can wrap spherical vegetable automatically according to its size and shape, and doesn't need to place it on a ploystyrene tray, further more the spherical vegetable can be wrapped fast and directly by a shape sensor to get an unharmed vgegtable.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENT

Referring to FIG. 1 to FIG. 4, the present invention packing machine for spherical vegetable is composed of a machine body(01), a film-gripping part(03), a film-cutting part(04), a clamping device(05), a loading holder(06) with lifting mechanism(06) and a heat sealing mechanism(08), at the rear top of the machine body(01) having a pair of supporting rollers(11) ('11) for positioning packing film(02), at one side of the pair of supporting rollers(11) ('11) having a slack adjusting plate(12) used for adjusting the tightness of the packing film(02). The film-cutting part(04) is installed on the rear part of the machine body(01) and can be moved upwardly or downwardly, at the front part of the film-cutting part(04) having a buttress cutter(42) which can cut off the packing film(02) easily, behind the film-cutting part(04) having a clamping device(05) which is composed a plurality of upper clamping plates(51) and lower clamping rods(52), the upper clamping plates being fixed and the lower clamping rods(52) can be moved upwardly or downwardly so as to match the upper clamping plates(51) to clamp the packing film(02). The film-gripping part(03) is installed opposite to the clamping device(05) and composed of an upper gripping jaw(31) and a lower gripping jaw(31'), at the front end of the film-gripping part(03) having a plurality of apertures(32) which face to the lower clamping rods(52) of the clamping device(05) so as to prevent the film-gripping part(03) from colliding with the lower clamping rods(52), the two ends of the film-gripping part(03) being connected respectively with a transmission chain(33) which is transmitted by a motor so as to make the film-gripping part(03) can be slided forwardly and backwardly on a pair of guide rails(34) which are fitted with two ends of the film-gripping part(03) and fixed on the machine body(01).

Figure 1:
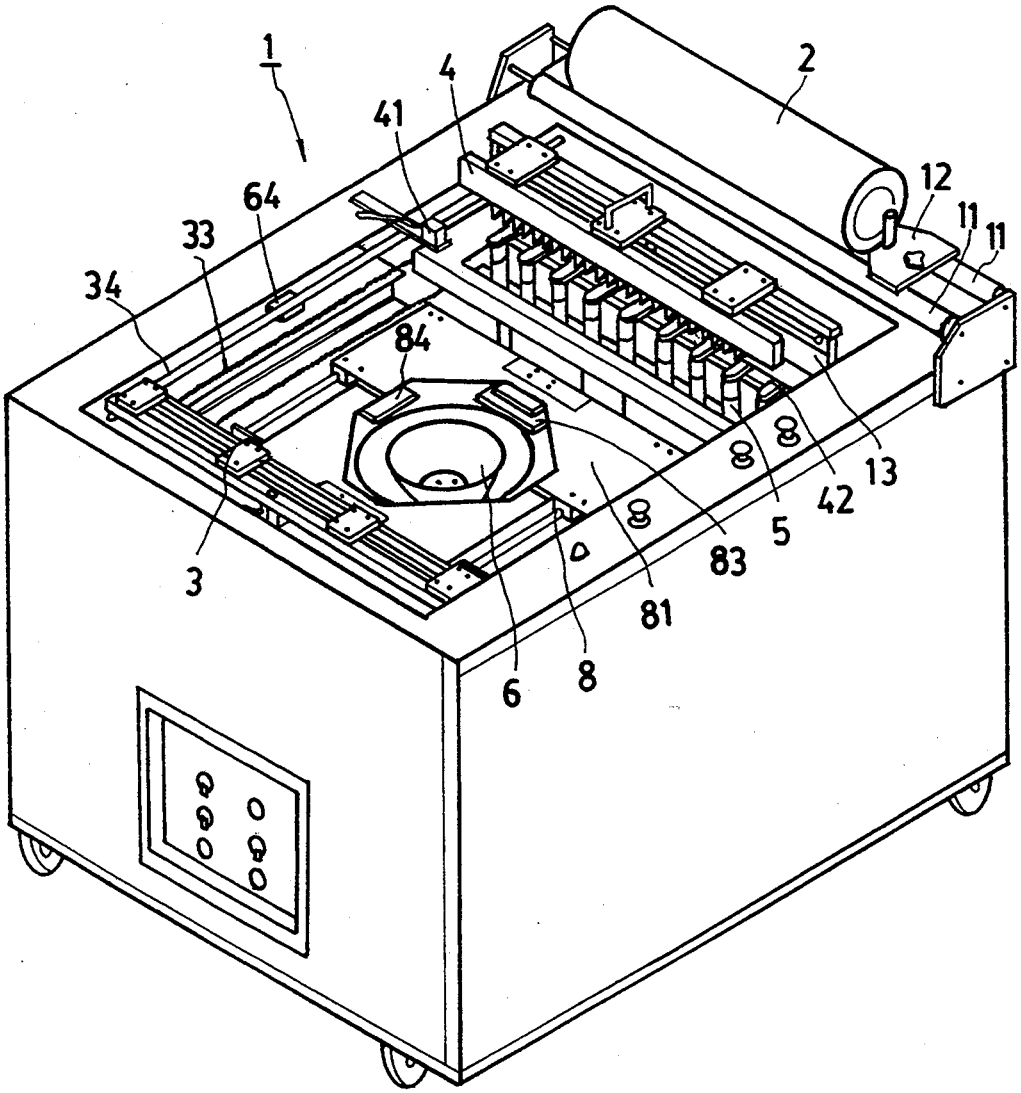
FIG. 1 is a perspective view of the packing machine for spherical vegetable of this invention.
Figure 2:
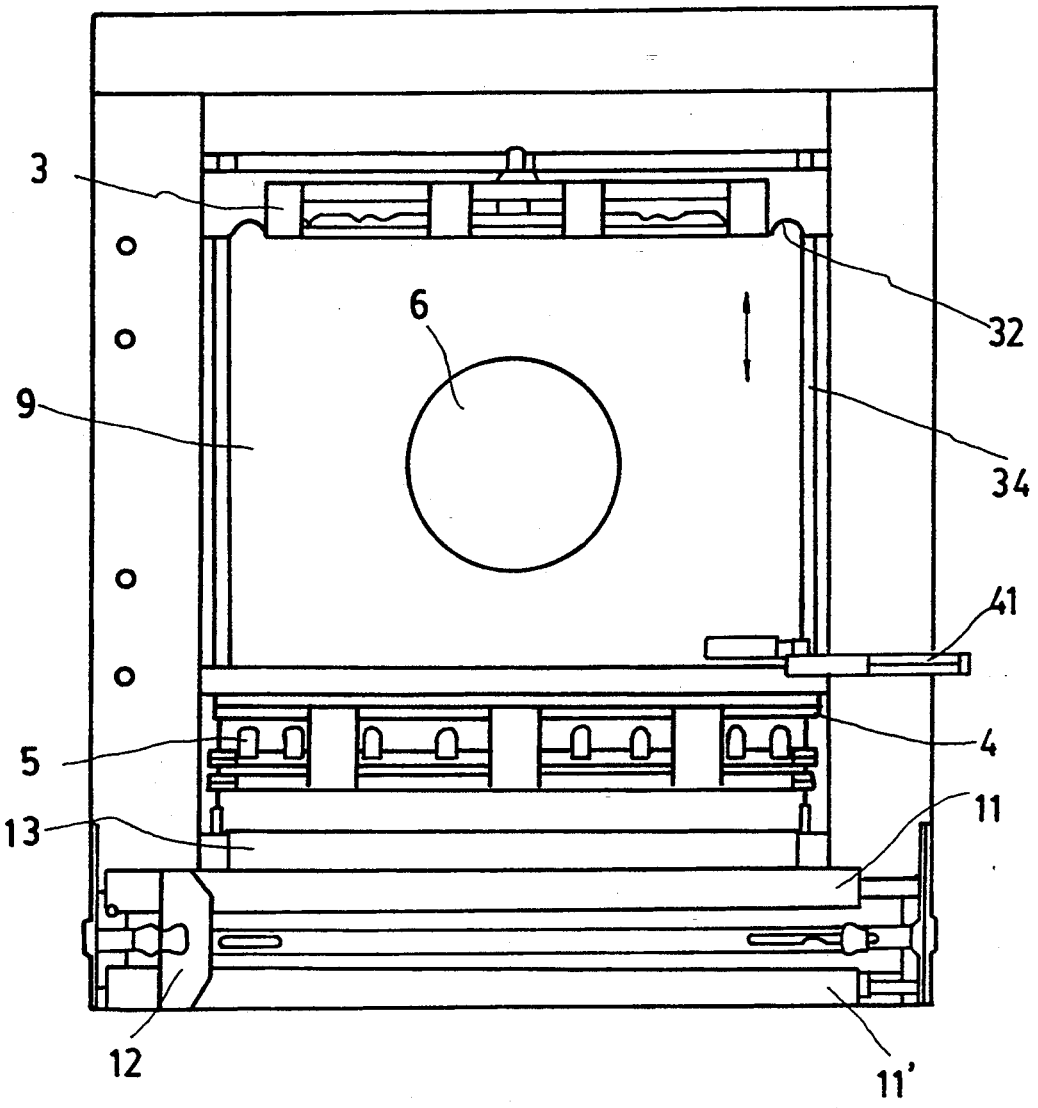
FIG. 2 is a top plan view of this invention.
Figure 3:
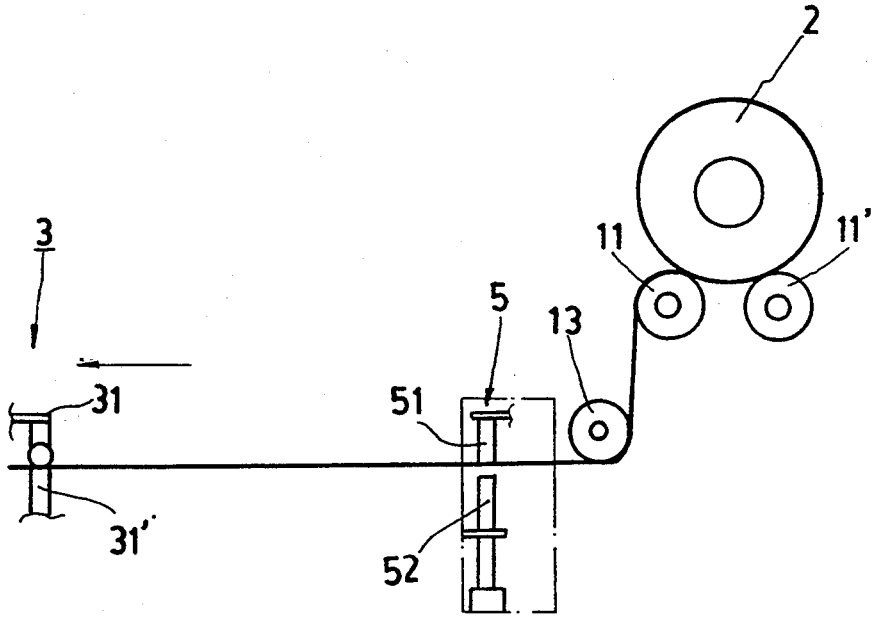
FIG. 3 is a plan view showing the gripping action of the film-gripping part of this invention.
Figure 4:
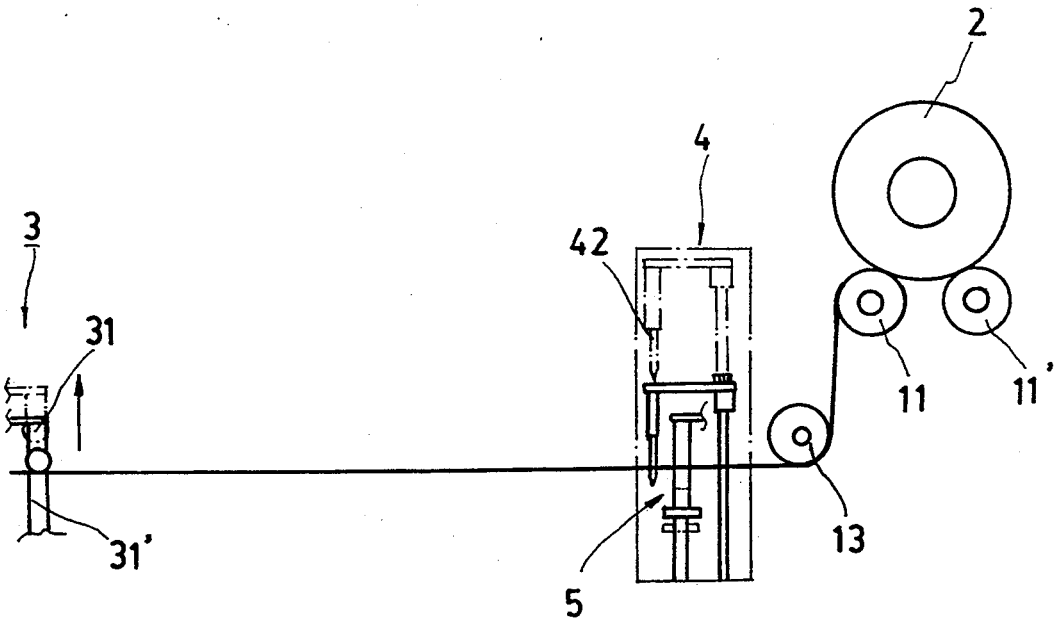
FIG. 4 is a plan view showing the cutting action of the film-cutting part of this invention.

The packing film(02) is positioned on the supporting rollers(11) ('11) and drew through a guide roller(13) to the clamping device(05), the packing film(02) being clamped by the upper clmaping plates(51) and the relative lower clamping rods(52), when starting the packing machine, the film-gripping part(03) would slide forwardly along the guide rails(34) to the clamping device(05) by means of the transmission chains(33), furthermore the apertures(32) of the film-gripping part(03) being fitted into the lower clamping rods(52) so as to make the upper gripping jaw(31) and the lower gripping jaw(31') of the film-gripping part(03) can grip the packing film(02), meanwhile the lower clamping rods(52) would be moved downwardly to make the film-gripping part(03) can grip the packing film(02) and go back to its film-gripping part(03) being controlled by a stroke electric eye(41). When the film gripping part(03) goes back to its original position, the lower clamping rods(52) rising up to clamp the packing film(02), meanwhile the film-cutting part(04) would move downwardly to cut off the packing film(02), such as shown in FIG. 4, then the film-cutting part(04) would rise up again to its original place, meanwhile the upper gripping jaw(31) rising up to loosen the packing film(02).

Figure 5:
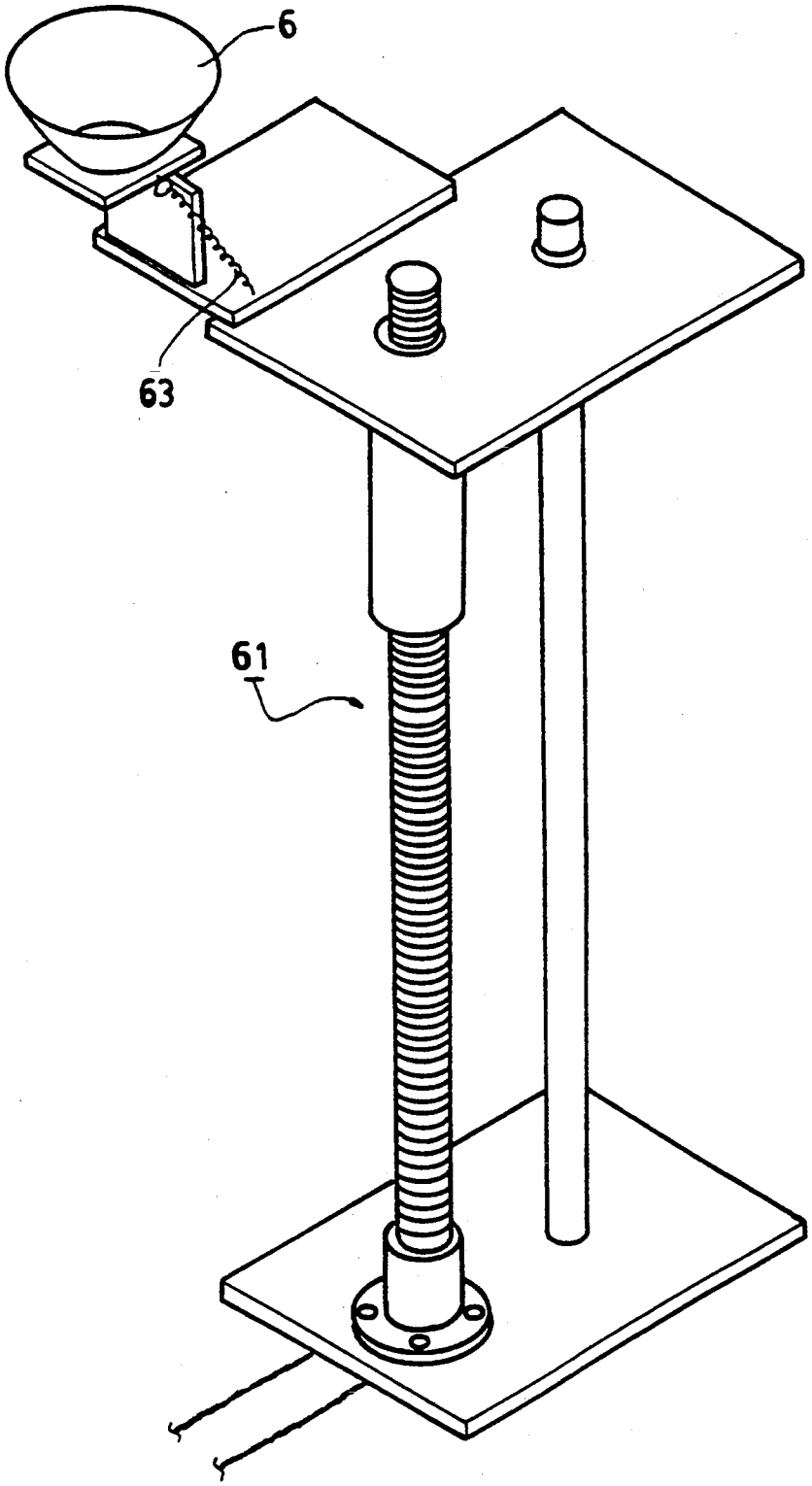
FIG. 5 is a perspective view of the loading holder with lifting mechanism of this invention.
Figure 6:
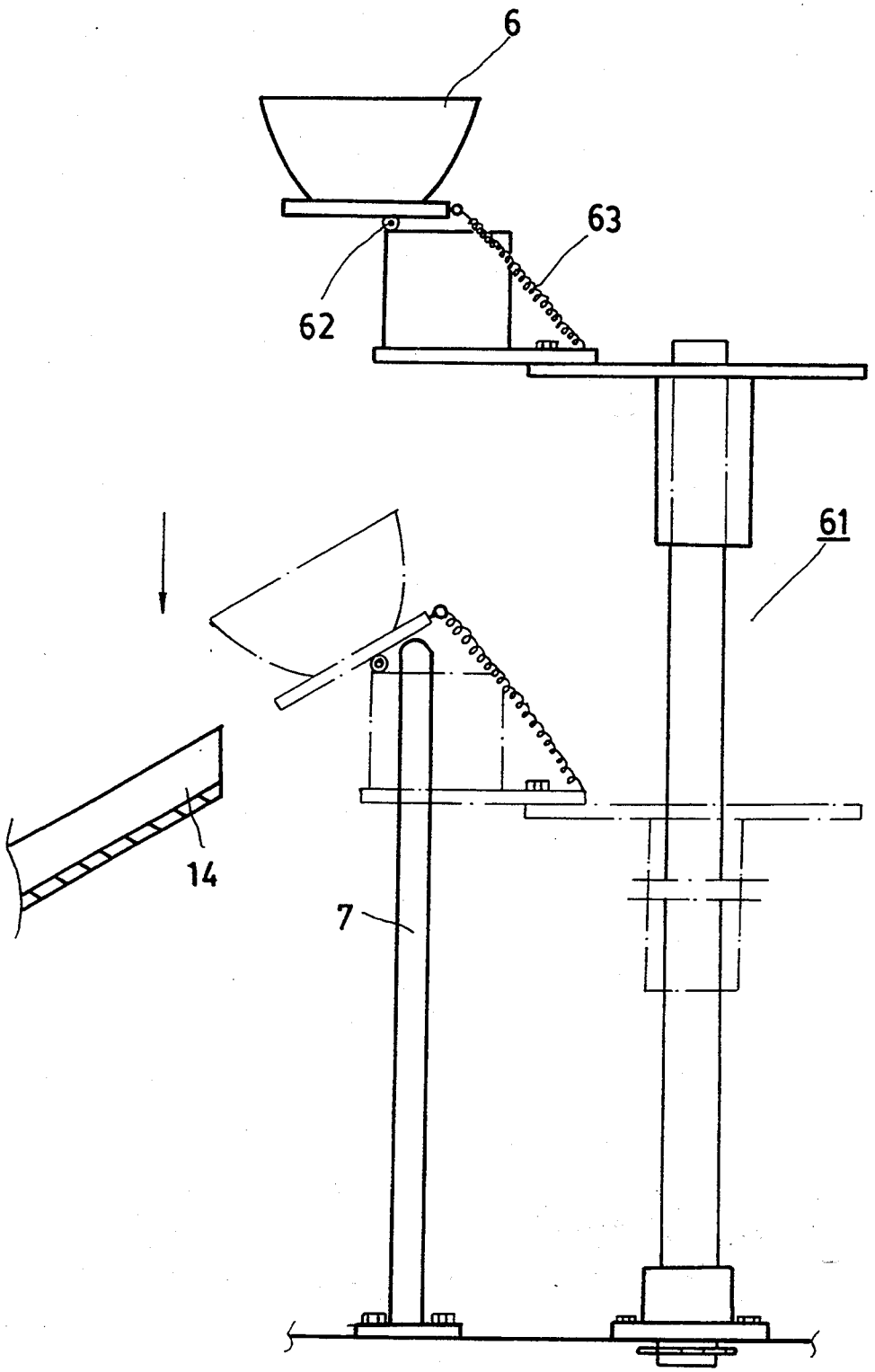
FIG. 6 is a top plan view showing the movging action of the loading holder of this invention.
Figure 7:
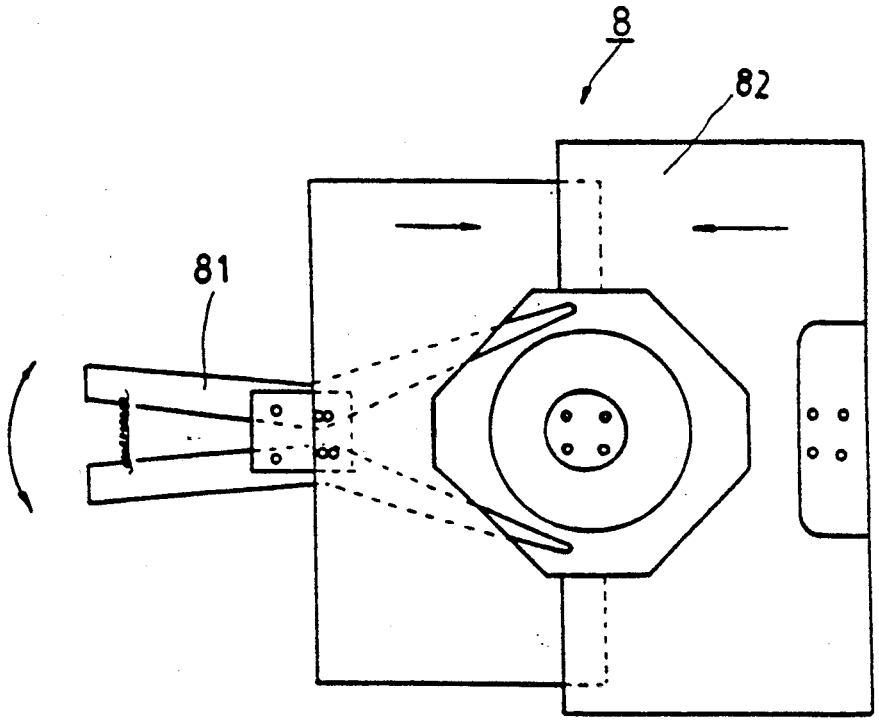
FIG. 7 is a top plan view showing the heat sealing mechanism of this invention.
Figure 8:
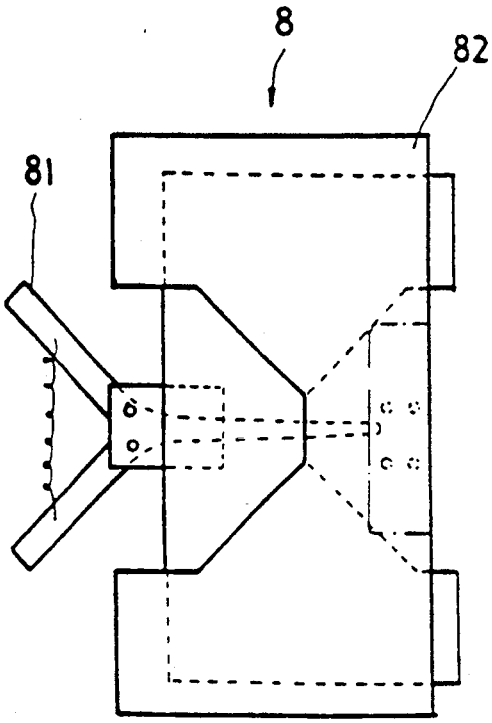
FIG. 8 is a top plan view showing the moving action of the heat sealing mechanism of this invention.
Figure 9:
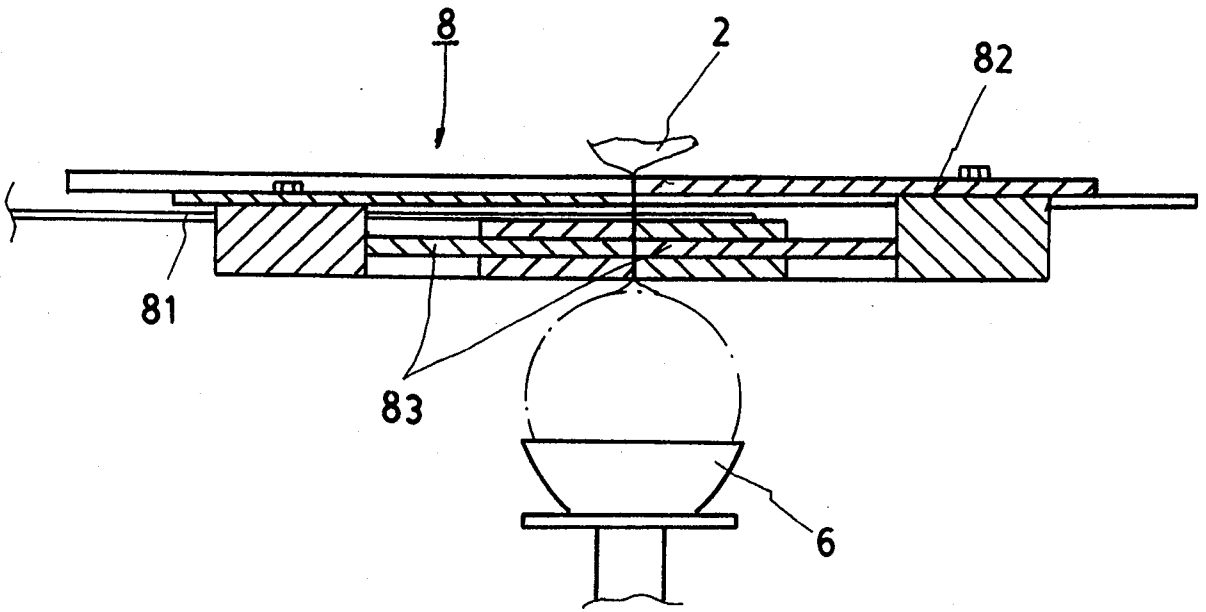
FIG. 9 is a part sectional view showing the sealing status of the heat sealing mechanism.

Referring to FIG. 5 and FIG. 6, after the packing film(02) being cut off, the operator can put the spherical vegetable on the loading holder(06), when the detecting electric eye(64) detects the spherical vegetable has been laid on the loading holder(06), the loading holder(06) would lower automatically to an appropriate position by means of a lifting mechanism(61), the stroke being decided according to the size and shape of the spherical vegetable which can be detected by a shape electric eye(84), this time the packing film(02) like a hopper shape, the upper part of the hopper-shape packing film(02) being held in advance by a clipper(81) of the heat sealing mecanism(08), meanwhile the upper part of the packing film(02) being sealed and cut off by a heat sealing cutter(83) which is situated under the clipper(81).

please refer to FIG. 7 to FIG. 9, the loading holder(06) being hinged on the lifting mechanism(61) and can rotate around the hinge(62), the loading holder(06) being connected with the lifting mechanism(61) with a spring(63), when completing the packing process, the loading holder(06) continues to move downwardly until it contacts with a upright post(07), then the loading holder(06) would be pushed to a slant position such as shown in FIG. 6, therefore the packed vegetable would slip off from the loading holder(06), then going through an incline passage(14) to a conveyor device. In addition, the working platform of the packing machine(01) is covered with a protecting plate(09) which can prevent the packing film(02) from attaching to the working platform and prevent the heat sealing mechanism(08) from hurting operator's hands.

It is understood by those skilled in the art that the foregoing description is a preferred embodiment of the disclosed device and that various changes and modifications may be made in the invention without departing from the spirit and scope thereof.

What is claimed is:

1. A packing machine for spherical vegetables comprising:

a machine body carrying a pair of supporting rollers for positioning packing film at a rear top portion of said machine body, a slack adjusting plate arranged at one side of said supporting rollers for tensioning the packing film, and a film-cutting part secured to a rear portion of said machine body, said film-cutting part including a buttress cutter at a front portion thereof;

clamping means including a plurality of upper clamping plates and multiple lower clamping rods, said upper clamping plates being fixed relative to said lower clamping rods, said lower clamping rods being shiftable towards said upper clamping plates in order to clamp the packing film and away from said upper clamping plates to release the packing film;

film-gripping means arranged opposite said clamping means and including an upper gripping jaw and a lower gripping jaw, said film-gripping means having a plurality of apertures opening toward said lower clamping rods and functioning to prevent said film-gripping means from colliding with said lower clamping rods during operation of said machine, said film-gripping means including a pair of guide rails that support said upper and lower gripping jaws and two ends connected to a transmission chain adapted to be driven by a motor for shifting said film-gripping means in a forward direction toward said clamping means and a backward direction away from said clamping means on said pair of guide rails;

a loading, lifting and delivering assembly below said clamping and said film gripping means, including a loading holder for receiving generally spherically-shaped vegetables, a lifting mechanism and a fixed upright post, said loading holder being hingedly connected to said lifting mechanism so as to be rotatable relative to said lifting mechanism between loading and unloading positions, said loading holder being further connected to said lifting mechanism by means of a spring which biases said loading holder into a predetermined rotatable position relative to said lifting mechanism, said lifting mechanism functioning to shift said loading holder substantially vertically wherein, when said loading holder is lowered, said loading holder engages said upright post which causes said loading holder to rotate, relative to said lifting mechanism, from said loading position to said unloading position; and heat sealing means, arranged above said loading holder, including a clip applying unit, a pair of clamping plates and a heat sealing cutter, said heat sealing cutter being positioned under said clamping plates, wherein said film-gripping means is adapted to shift, from an initial position, toward said clamping means whereat said film-gripping means grips the packing film supplied to said clamping means, and to return to its initial position while said film-cutting means is lowered to cut the packing film to a predetermined length, then a spherical vegetable is delivered upon the packing film and arranged in said loading holder and, while said clip applying unit clips the packing film, said clamping plates shift into engagement with the packing film and said heat sealing cutter cuts and simultaneously seals an upper part of the packing film about the spherical vegetable and, then said loading holder is shifted to its unloading position by said lifting mechanism and said upright post then a spherical vegetable arranged on said loading holder is delivered upon the packing film by shifting of said loading holder to its unloading position by said lifting mechanism and said upright post and, while said clip applying unit clips the packing film, said clamping plates shift into engagement with the packing film and said heat sealing cutter cuts and simultaneously seals an upper part of the packing film about the spherical vegetable.

* * * * *